US006730650B1

(12) United States Patent
Wood

(10) Patent No.: US 6,730,650 B1
(45) Date of Patent: May 4, 2004

(54) HEAVY-DUTY LIQUID DETERGENT COMPOSITION COMPRISING ANIONIC SURFACTANTS

(75) Inventor: Daniel Wood, Phoenix, AZ (US)

(73) Assignee: The Dial Corporation, Scottsdale, AZ (US)

( * ) Notice: Subject to any disclaimer, the term of this patent is extended or adjusted under 35 U.S.C. 154(b) by 85 days.

(21) Appl. No.: 10/192,331

(22) Filed: Jul. 9, 2002

(51) Int. Cl.[7] ..... C11D 17/00

(52) U.S. Cl. ..... 510/351; 510/352; 510/357; 510/426; 510/492; 510/536; 510/537

(58) Field of Search ..... 510/351, 352, 510/357, 426, 492, 536, 537

(56) References Cited

U.S. PATENT DOCUMENTS

| | | | | |
|---|---|---|---|---|
| 3,925,224 | A | | 12/1975 | Winston |
| 4,075,129 | A | | 2/1978 | Murata et al. |
| 4,105,592 | A | | 8/1978 | Collins |
| 4,133,772 | A | | 1/1979 | Kaplan et al. |
| 4,147,649 | A | | 4/1979 | Arnau et al. |
| 4,259,215 | A | | 3/1981 | Murata et al. |
| 4,259,217 | A | | 3/1981 | Murphy |
| 4,333,862 | A | | 6/1982 | Smith et al. |
| 4,390,466 | A | | 6/1983 | Weinberger |
| 4,530,780 | A | | 7/1985 | van de Pas et al. |
| 4,547,306 | A | | 10/1985 | Hase et al. |
| 4,659,497 | A | | 4/1987 | Akred et al. |
| 4,692,275 | A | | 9/1987 | Secemski et al. |
| 4,765,926 | A | * | 8/1988 | Plummer ..... 510/498 |
| 4,842,757 | A | | 6/1989 | Reboa et al. |
| 4,902,439 | A | | 2/1990 | Abel et al. |
| 5,102,573 | A | | 4/1992 | Han et al. |
| 5,130,056 | A | | 7/1992 | Jakobson et al. |
| 5,370,816 | A | | 12/1994 | Balzer et al. |
| 5,403,515 | A | | 4/1995 | Instone et al. |
| 5,415,812 | A | | 5/1995 | Durbut et al. |
| 5,500,151 | A | | 3/1996 | Cao et al. |
| 5,587,356 | A | | 12/1996 | Dauderman et al. |
| 5,703,036 | A | | 12/1997 | Iakovides |
| 5,705,467 | A | | 1/1998 | Choy |
| 5,731,276 | A | | 3/1998 | Argo et al. |
| 5,756,441 | A | | 5/1998 | Thomas et al. |
| 5,780,417 | A | | 7/1998 | Gorlin |
| 5,919,745 | A | | 7/1999 | Cala et al. |
| 5,922,664 | A | | 7/1999 | Cao et al. |
| 5,972,869 | A | | 10/1999 | Cao et al. |
| 5,994,285 | A | | 11/1999 | Sachdev et al. |
| 6,017,874 | A | | 1/2000 | Lappas et al. |
| 6,040,287 | A | | 3/2000 | Motyka et al. |
| 6,046,152 | A | | 4/2000 | Vinson et al. |
| 6,060,441 | A | | 5/2000 | Hessel et al. |
| 6,087,309 | A | | 7/2000 | Vinson et al. |
| 6,087,314 | A | | 7/2000 | Heinzman et al. |
| 6,087,321 | A | | 7/2000 | Panandiker et al. |
| 6,114,297 | A | | 9/2000 | Yamaguchi et al. |
| 6,130,193 | A | | 10/2000 | Gillette |
| 6,162,780 | A | | 12/2000 | Partee et al. |
| 6,172,024 | B1 | | 1/2001 | Arvanitidou |
| 6,177,397 | B1 | | 1/2001 | Staley |
| 6,180,583 | B1 | | 1/2001 | Cilley et al. |
| 6,194,370 | B1 | | 2/2001 | Williams, Jr. et al. |
| 6,207,633 | B1 | | 3/2001 | Kettenacker et al. |
| 6,221,825 | B1 | | 4/2001 | Williams, Jr. et al. |
| 6,239,093 | B1 | | 5/2001 | Foley et al. |
| 6,248,709 | B1 | | 6/2001 | Kandasamy et al. |
| 6,262,007 | B1 | | 7/2001 | Scialla et al. |

* cited by examiner

*Primary Examiner*—Necholus Ogden
(74) *Attorney, Agent, or Firm*—Snell & Wilmer LLP

(57) ABSTRACT

A liquid detergent composition includes an anionic surfactant component, a viscosity-enhancing agent, and a liquid carrier. The liquid detergent composition is substantially free of nonionic surfactant. The anionic surfactant component is present in an amount at least as great as about 2% by weight. The anionic surfactant component is also present in an amount no greater than about 7% by weight. The anionic surfactant component includes an alkyl ether sulfate material and a linear alkyl benzene sulfonate material which are present in a ratio in the range of from about 5:1 to about 1:0.5. The viscosity-enhancing agent is present in an amount sufficient so that the liquid detergent composition has a viscosity no less than about 120 centipoise.

22 Claims, No Drawings

HEAVY-DUTY LIQUID DETERGENT COMPOSITION COMPRISING ANIONIC SURFACTANTS

FIELD OF INVENTION

The present invention relates generally to a liquid detergent composition and more particularly to a heavy-duty liquid detergent composition having relatively small amounts of anionic surfactants, at least one viscosity-enhancing agent and a liquid carrier, and which is substantially free of nonionic surfactants.

BACKGROUND OF THE INVENTION

Heavy-duty liquid laundry detergents generally have high amounts of surfactants, that is, 10% by weight or greater. Surfactants promote and facilitate the removal of stains and soil from fabrics laundered in wash solutions formed from such liquid detergents and water. Typically, these laundry detergents have both nonionic and anionic surfactant components. Nonionic surfactant components, which are relatively expensive components of liquid detergents, are generally added to detergents to remove stains and soil, particularly to remove oil and grease. However, when present above certain levels, nonionic surfactant components significantly reduce the viscosity of the liquid laundry detergent, thus rendering the detergent composition unstable. While inorganic electrolytes generally may increase the viscosity of the liquid detergent, nonionic surfactant components may cause inorganic electrolytes to precipitate from the solution. Accordingly, to compensate for the reduced viscosity of the detergent, organic thickeners and hydrotropes are generally added to the detergent. However, addition of such components may significantly increase the cost of the liquid laundry detergent.

Anionic surfactants are also added to detergents for the removal of stains and soils. However, when present above a certain amount, anionic surfactants result in redeposition of the dirty wash solution on the items being washed. Unless inhibited, such redeposition on the fabrics tends to create unsightly films. After several washes, particularly in the case of colored fabrics, such redeposition can result in fading or other loss of color.

While attempts have been made to provide a low cost heavy-duty liquid detergent that provides satisfactory cleaning with improved anti-redeposition properties, none have satisfactorily accomplished that objective, particularly in the context of a stable, suitably viscous heavy-duty liquid detergent. The present invention addresses this long felt, yet unresolved need.

SUMMARY OF THE INVENTION

This summary of the invention section is intended to introduce the reader to aspects of the invention and is not a complete description of the invention. Particular aspects of the invention are pointed out in other sections herein below, and the invention is set forth in the appended claims which alone demarcate its scope.

In accordance with an exemplary embodiment of the present invention, a liquid detergent composition is provided. The liquid detergent composition includes an anionic surfactant component, a viscosity-enhancing agent, and a liquid carrier. The liquid detergent composition is substantially free of nonionic surfactant. The anionic surfactant component is present in an amount at least as great as about 2% by weight. The anionic surfactant component is also present in an amount no greater than about 7% by weight. The anionic surfactant component includes an alkyl ether sulfate material and a linear alkyl benzene sulfonate material. The alkyl ether sulfate material and the linear alkyl benzene sulfonate material are present in a ratio in the range of from about 5:1 to about 1:0.5. The viscosity-enhancing agent is present in an amount sufficient so that the liquid detergent composition has a viscosity no less than about 120 centipoise.

In accordance with another exemplary embodiment of the present invention, a liquid detergent composition is provided. The liquid detergent composition consists essentially of an anionic surfactant component, a viscosity-enhancing agent, optionally at least one additive, and a liquid carrier. The anionic surfactant component is present in an amount at least as great as 3% by weight. The anionic surfactant component is also present in an amount no greater than about 6% by weight. The anionic surfactant component comprises an alkyl ether sulfate material and a linear alkyl benzene sulfonate material which are present in a ratio in the range of from about 4:1 to about 1:1. The viscosity enhancing agent is present in an amount at least as great as 2% by weight. The viscosity enhancing agent is also present in an amount no greater than 10% by weight.

DETAILED DESCRIPTION

The following description is of exemplary embodiments only and is not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

The heavy-duty liquid detergent composition of the present invention comprises a relatively small amount of anionic surfactant component, at least one viscosity-enhancing agent and a relatively large amount of a liquid carrier. The anionic surfactant component is present in amounts equal to or above a minimum amount at which at least partial removal of stains and soils occurs. The anionic surfactant component is also preferably present in an amount less than an amount at which substantial redeposition of soil occurs. In a preferred embodiment of the invention, the liquid laundry detergent comprises an amount of anionic surfactant component in the range of from about 2% by weight to about 7% by weight. In a more preferred embodiment of the invention, the liquid laundry detergent comprises an amount of an anionic surfactant component in the range of from about 3% by weight to about 6% by weight.

The anionic surfactant component may comprise at least two anionic surfactant materials. In one exemplary embodiment of the present invention, the first anionic surfactant material may comprise a linear alkyl benzene sulfonate (LAS) material having about 8 to 14 carbon atoms or any combination of linear alkyl benzene sulfonates having about 8 to 14 carbon atoms. The LAS material may comprise a water-solubilizing cation formed of an alkali metal. In a preferred embodiment of the invention, the first anionic surfactant material comprises an LAS having about 11 to 13 carbon atoms or any combination of LAS having about 11 to 13 carbon atoms. In a more preferred embodiment, the LAS material comprises a sodium alkylbenzene sulfonate. Optimally, the LAS material comprises sodium dodecylbenzene sulfonate.

In another exemplary embodiment of the present invention, the second anionic surfactant material may comprise an alkyl ether sulfate (AES) material having from about 8 to 18 carbon atoms or any combination of alkyl ether sulfates having from about 8 to 18 carbon atoms. The ethylene oxide content may be from 1 to 9 moles. The AES material may comprise a water-solubilizing cation formed of an alkali metal. In a preferred embodiment of the invention, the second anionic surfactant material comprises an AES having about 12 to 14 carbon atoms and about 2 moles of ethylene oxide. In a more preferred embodiment, the AES material comprises sodium lauryl ether sulfate.

In a further exemplary embodiment of the invention, the AES and LAS materials are present in a ratio that ranges from about 5:1 to about 1:0.5, respectively. When present at a ratio of this range, the performance of the surfactant component of the liquid detergent is optimized. In particular, it is desirable to have a relatively low amount of LAS because of its tendency to result in soil redeposition however, it is desirable to have LAS present in the laundry detergent as the LAS facilitates thickening of the laundry detergent. The presence of AES in the liquid detergent is desirable because of the cleaning capabilities of AES and because it assists in preventing soil redeposition. In addition, while LAS generally has reduced performance in hard water, AES is not hard-water sensitive. Preferably, the AES and LAS materials are present in a ratio that ranges from about 4:1 to about 1:1. More preferably, the AES and LAS materials are present in a ratio that ranges from about 3:1 to about 2:1.

In another exemplary embodiment, the liquid detergent composition of the present invention includes a viscosity-enhancing agent that enhances the viscosity of the liquid detergent composition. In one embodiment of the invention, the viscosity-enhancing agent comprises one or more inorganic electrolytes, such as, for example, soluble chlorides, sulfates, silicates, carbonates or any other suitable material or combination of materials which, when present in a suitable amount, is sufficient to cause the liquid detergent composition to exhibit a viscosity of at least 120 centipoise. Preferably, the viscosity-enhancing agent is present in an amount sufficient to cause the liquid detergent composition to exhibit a viscosity of at least 130 centipoise. In one exemplary embodiment of the invention, the liquid detergent composition comprises about 3 to about 11% by weight of the viscosity-enhancing agent. More preferably, the liquid detergent composition comprises about 2 to about 10% by weight of the viscosity-enhancing agent. Amounts above this generally provide little additional benefit while increasing costs unnecessarily.

In another embodiment of the invention, the liquid detergent composition is substantially free of nonionic surfactant. As used herein, "substantially free of nonionic surfactant" means that, to the extent nonionic surfactant is present, it is present in an amount below that which would significantly adversely affect the viscosity of the liquid detergent composition. In one exemplary embodiment of the invention, nonionic surfactant is present in the liquid detergent composition in an amount below that which would counteract the function of the viscosity-enhancing agent and cause the liquid detergent composition to exhibit a viscosity below about 120 centipoise. Presence of nonionic surfactant below such an amount does not require the addition of organic thickeners and/or hydrotropes to compensate for reduced viscosity caused by the presence of the nonionic surfactant. It will be appreciated, however, that, while not necessary, organic thickeners and hydrotropes may be added to the liquid detergent composition to facilitate any desired application. Preferably, the liquid detergent composition includes no more than about 0.5% by weight of nonionic surfactant. More preferably, the liquid detergent of the present invention is free of nonionic surfactant.

The liquid detergent composition of the present invention also includes an aqueous, non-surface-active liquid cannier. The liquid detergent typically comprises about 80 to 95 weight percent of the liquid carrier. Preferably, the liquid carrier comprises water, as water is a readily available, relatively-inexpensive liquid carrier. However, other suitable solvents may include mixtures of water and other water-miscible solvents such as, for example, glycols.

In another exemplary embodiment of the present invention, the liquid detergent composition may include one or more other conventional additives such as brighteners, bleaching agents, fragrance, chelating agents, builders and dyes. One or more of these additives may be present in any amount suitable to achieve a particular objective. In a preferred embodiment of the invention, these additives, alone or combined, are not present in an amount that is greater than 4% by weight of the liquid detergent composition. In a more preferred embodiment of the invention, these additives, alone or combined, are not present in an amount that is greater than 2% by weight of the liquid detergent composition.

The liquid detergent composition according to various aspects of the present invention can be prepared by combining the first anionic surfactant material, the second anionic surfactant material, the viscosity-enhancing agent and the liquid carrier in any suitable order by any convenient method of mixing, such as, for example, by rapidly stirring with a mechanical stirrer or by agitating with a mechanical agitator. Any other additives may also be added to the liquid detergent composition using any suitable method.

An exemplary embodiment of the liquid detergent composition of the present invention, with each of the components set forth in weight percent, is as follows:

| Component | Weight % |
|---|---|
| sodium lauryl ether sulfate | 2.8 |
| sodium dodecylbenzene sulfonate | 1.1 |
| sodium carbonate | 3.5 |
| sodium chloride | 1.25 |
| flourescent whitening agent (Na salt) | 0.03 |
| chelating agent (tetrasodium EDTA) | 0.08 |
| dye (liquitent blue-HP) | 0.0011 |
| perfume | 0.13 |
| water | 91.1089 |
| Total | 100.00 |

While the above example illustrates a liquid detergent composition comprising an AES material of sodium lauryl ether sulfate, an LAS material of sodium dodecylbenzene sulfonate, a viscosity-enhancing agent comprising a combination of sodium carbonate and sodium chloride, and a liquid carrier of water, it will be appreciated that any other suitable AES material, LAS material, viscosity-enhancing agent, and/or liquid carrier may be used and may be present in any suitable amount. Similarly, while the above example illustrates use of a fluorescent whitening agent, chelating agent, dye and perfume, it will be understood that any other conventional, suitable additive or combination of additives, present in any suitable proportion, may be used. Further, it will be appreciated that any or all such additives may be absent from the liquid detergent composition altogether.

To evidence the performance characteristics of various formulations of the liquid detergent composition according to the present invention, tests were conducted to determine the stain removal capability of the various formulations. Similarly sized, colored and content (100% cotton knit) pieces of fabric which were each stained with one of spaghetti sauce, dirt, ketchup, chocolate ice cream, and lipstick were washed in a wash liquor containing water and one of four formulations formed in accordance with various aspects of the present invention. These four formulations, with each of the components set forth in weight percent, are as follows:

| | weight percent | | | |
|---|---|---|---|---|
| | Formulation 1 | Formulation 2 | Formulation 3 | Formulation 4 |
| sodium alkylbenzene sulfonate | 1.25 | 1.25 | 2 | 1.25 |
| sodium lauryl ether sulfate | 2.5 | 2.5 | 3.7 | 35 |
| sodium carbonate | 3.1 | 5 | 2 | 2 |
| water | 93.15 | 91.25 | 92.3 | 93.25 |
| Viscosity (centipoise) | 160 | 255 | 175 | 225 |

Viscosities were calculated using a Brookfield LVT model.

The stain removal capability of these four formulations were compared with three formulations of liquid detergents that comprised at least 2% by weight of nonionic surfactant. These three formulations, with each of the components set forth in weight percent, are as follows:

| | weight percent | | |
|---|---|---|---|
| | Formulation 5 | Formulation 6 | Formulation 7 |
| sodium alkylbenzene sulfonate | 1.25 | 2 | 1.25 |
| sodium lauryl ether sulfate | 2.5 | 3.7 | 3.5 |
| nonionic surfactant | 2.0 | 2.2 | 2.5 |
| sodium carbonate | 3.1 | 2 | 2 |
| water | 91.15 | 90.1 | 90.75 |
| Viscosity (centipoise) | 95 | 130 | 125 |

As evidenced above, Formulation 5 is substantially similar to Formulation 1 but includes 2% by weight of nonionic surfactant. Formulation 6 is substantially similar to Formulation 3 but includes 2.2% by weight of nonionic surfactant. Formulation 7 is substantially similar to Formulation 4 but includes 2.5% by weight of nonionic surfactant.

Stain removal was assessed by comparing the stained pieces of fabric after washing against white 100% cotton knit pieces of fabric. Stain removal was assessed using colormetric readings from a Gardner Color-Guide Spectrophotometer Model 45/0. The data obtained was evaluated to determine the Total Color Difference, namely ΔE, where $$\Delta E=\sqrt{(L^f-W_o)^2+(A_f-A_o)^2+(B_f-A_o)^2}$$

and L, A and B refer to the widely accepted tristimulus L, A, B scale coordinates, where L approximates the non-linear black-white response, and A and B identify the hue and chroma of the material on red-green and yellow-blue scales, respectively. The subscript "f" represents the value after washing and the subscript "o" represents the white cloth readings. In accordance with such evaluations, a high ΔE is reflective of high (i.e. significant) color change, that is, low stain removal. A difference in stain removal test scores of at least about 0.2 to about 0.3 indicates a visible difference in stain removal.

The cost of each formulation was determined based on cost of the components for 100 units of use, where 100 units of use comprises a "case" of the liquid detergent.

The results of the stain removal tests are as follows:

| Formulation | Spaghetti Sauce | Dirt | Ketchup | Chocolate Ice Cream | Lipstick | Cost ($/case) |
|---|---|---|---|---|---|---|
| 1 | 3.6 | 11.3 | 2.8 | 4.4 | 3.0 | 0.96 |
| 2 | 3.6 | 11.5 | 3.5 | 5.2 | 2.4 | 1.00 |
| 3 | 4.0 | 10.6 | 1.9 | 4.1 | 2.7 | 1.20 |
| 4 | 4.1 | 10.7 | 2.8 | 3.9 | 2.8 | 1.10 |
| 5 | 3.9 | 11.1 | 2.4 | 4.6 | 2.9 | 1.20 |
| 6 | 4.4 | 10.6 | 1.9 | 4.2 | 2.6 | 1.50 |
| 7 | 4.4 | 10.7 | 2.3 | 4.2 | 2.9 | 1.40 |

The above results illustrate that the addition of the nonionic surfactant in an amount as high as 2% by weight increased the cost of the liquid detergent composition without significantly increasing the cleaning capability of the liquid detergent composition. Comparing Formulation 1 to Formulation 5, while Formulation 5 was $0.24 per case higher than Formulation 1, Formulation 1 exhibited better removal of the spaghetti sauce and chocolate ice cream stains. Removal of the lipstick stain was about the same for both formulas. Formulation 5 exhibited better removal of the dirt and ketchup stain than Formulation 1. Comparing Formulation 3 to Formulation 6, while Formulation 6 was $0.30 per case higher than Formulation 3, Formulation 3 illustrated better removal of the spaghetti sauce stain. Removal of the other stains was about the same for both formulas. Comparing Formulation 4 to Formulation 7, while Formulation 7 was $0.30 per case higher than Formulation 4, Formulation 4 exhibited better removal of the spaghetti sauce and chocolate ice cream stains. Removal of the lipstick stain and dirt stain was about the same for both formulas. Formulation 7 exhibited better removal of the ketchup stain than Formulation 4.

The above results also indicate that addition of nonionic surfactant in an amount as low as 2% by weight significantly reduces the viscosity of the liquid detergent composition. Formulations 5, 6 and 7 each exhibited a viscosity that was at or below 130 centipoise. Accordingly, if nonionic surfactant is added in amounts sufficient to substantially increase the stain removal capabilities of the liquid detergent formulations, additional components would be required to compensate for the significant decrease in viscosity of the formulations, resulting in even greater cost of the formulations.

As should now be appreciated, the liquid detergent compositions in accordance with the various embodiments of the present invention evidence stain removal properties while comprising relatively small amounts of anionic surfactants, a viscosity-enhancing agent and a large amount of water, and while being substantially free of nonionic surfactants. Accordingly, the liquid detergent compositions in accordance with the various embodiments of the present invention may constitute effective, yet low-cost, heavy duty liquid detergent compositions.

In the foregoing specification, the invention has been described with reference to specific embodiments. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as a critical, required, or essential features or elements of any or all the claims. As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

I claim:

1. A liquid detergent composition comprising:

an anionic surfactant component;

said anionic surfactant component present in an amount at least as great as about 2% by weight;

said anionic surfactant component present in an amount no greater than about 7% by weight;

said anionic surfactant component comprising an alkyl ether sulfate material and a linear alkyl benzene sulfonate material, wherein said alkyl ether sulfate material and said linear alkyl benzene sulfonate material are present in a ratio in the range of from about 5:1 to about 1:0.5;

a viscosity-enhancing agent present in an amount sufficient so that said liquid detergent composition has a viscosity of no less than about 120 centipoise; and a liquid carrier, wherein said liquid detergent composition is substantially free of nonionic surfactant.

2. The liquid detergent composition of claim 1, said anionic surfactant component present in an amount at least as great as 3% by weight.

3. The liquid detergent composition of claim 1, said anionic surfactant component present in an amount no greater than 6% by weight.

4. The liquid detergent composition of claim 1, said detergent composition further comprising no more than about 0.5% by weight of nonionic surfactant.

5. The liquid detergent composition of claim 1, said viscosity-enhancing agent comprising at least one inorganic electrolyte selected from soluble chlorides, sulfates, silicates, and carbonates.

6. The liquid detergent composition of claim 1, said liquid detergent composition comprising at least about 2% by weight of said viscosity-enhancing agent.

7. The liquid detergent composition of claim 1, said linear alkyl benzene sulfonate material comprising at least one linear alkyl benzene sulfonate having from about 8 to about 14 carbons.

8. The liquid detergent composition of claim 1, said alkyl ether sulfate material comprising at least one alkyl ether sulfate having about 8 to 18 carbon atoms and about 1 to 9 moles of ethylene oxide.

9. The liquid detergent composition of claim 1, said linear alkyl benzene sulfonate material comprising sodium dodecylbenzenesulfonate.

10. The liquid detergent composition of claim 1, said alkyl ether sulfate material comprising sodium lauryl ether sulfate.

11. The liquid detergent composition of claim 1, said detergent composition comprising no more than about 10% by weight of said at least one inorganic electrolyte.

12. The liquid detergent composition of claim 1, said at least one inorganic electrolyte comprising sodium carbonate.

13. The liquid detergent composition of claim 1, wherein said alkyl ether sulfate and said linear alkyl benzene sulfonate are present in a ratio in the range of about 4:1 to about 1:1.

14. The liquid detergent composition of claim 1, wherein said alkyl ether sulfate and said linear alkylbenzenesulfonate are present in a ratio in the range of about 3:1 to about 2:1.

15. The liquid detergent composition of claim 1, said liquid carrier comprising water.

16. The liquid detergent composition of claim 1, wherein said viscosity-enhancing agent is present in an amount sufficient so that the liquid detergent composition has a viscosity of no less than about 130 centipoise.

17. A liquid detergent composition consisting essentially of:

an anionic surfactant component;

said anionic surfactant component present in an amount at least as great as 3% by weight;

said anionic surfactant component present in an amount no greater than about 6% by weight;

said anionic surfactant component comprising an alkyl ether sulfate material and a linear alkyl benzene sulfonate material, wherein said alkyl ether sulfate material and said linear alkyl benzene sulfonate material are present in a ratio in the range of from about 4:1 to about 1:1;

a viscosity enhancing agent, said viscosity enhancing agent present in an amount at least as great as 2% by weight;

said viscosity enhancing agent present in an amount no greater than 10% by weight;

optionally, at least one additive; and a liquid carrier.

18. The liquid detergent compositiion of claim 17, said viscosity-enhancing agent comprising at least one inorganic electrolyte selected from soluble chlorides, sulfates, silicates, and carbonates.

19. The liquid detergent composition of claim 17, said linear alkyl benzene sulfonate material comprising at least one linear alkyl benzene sulfonate having from about 8 to about 14 carbons.

20. The liquid detergent composition of claim 17, said alkyl ether sulfate material comprising at least one alkyl ether sulfate having about 8 to 18 carbon atoms and about 1 to 9 moles of ethylene oxide.

21. The liquid detergent composition of claim 17, said at least one additive selected from a fragrance, a brightener, a bleaching agent, a chelating agent, a dye and a builder.

22. The liquid detergent composition of claim 17, wherein said alkyl ether sulfate material and said linear alkyl benzene sulfonate material are present in a ratio in the range of about 3:1 to about 2:1.

* * * * *